US005945622A

United States Patent [19]

Yamada

[11] Patent Number: 5,945,622

[45] Date of Patent: Aug. 31, 1999

[54] SILENT STRINGED MUSICAL INSTRUMENT EQUIPPED WITH PICKUP FOR FAITHFULLY CONVERTING VIBRATIONS OF STRINGS TO ELECTRIC SIGNAL WITHOUT CHANGING VIBRATION CHARACTERISTICS OF BRIDGE

[75] Inventor: Toshiya Yamada, Shizuoka, Japan

[73] Assignee: Yamaha Corporation, Japan

[21] Appl. No.: 08/959,336

[22] Filed: Oct. 28, 1997

[30] Foreign Application Priority Data

Oct. 29, 1996 [JP] Japan ..... 8-286966

[51] Int. Cl.[6] ..... G10H 3/18

[52] U.S. Cl. ..... 84/731; 84/275; 84/309

[58] Field of Search ..... 84/274, 275, 291, 84/731, 743, 307, 309

[56] References Cited

U.S. PATENT DOCUMENTS

| | | | |
|---|---|---|---|
| 4,147,084 | 4/1979 | Underwood . | |
| 4,242,938 | 1/1981 | Zalinge | 84/731 |
| 4,632,002 | 12/1986 | Clevinger . | |
| 4,785,704 | 11/1988 | Fishman | 84/731 |
| 5,191,159 | 3/1993 | Jordan | 84/291 X |
| 5,463,185 | 10/1995 | Fishman | 84/731 |
| 5,537,906 | 7/1996 | Steinberger | 84/291 |

FOREIGN PATENT DOCUMENTS

| | | |
|---|---|---|
| 91 15844 | 10/1991 | WIPO . |
| 92 17879 | 10/1992 | WIPO . |

*Primary Examiner*—Jeffrey W. Donels
*Attorney, Agent, or Firm*—Ostrolenk, Faber, Gerb & Soffen, LLP

[57] ABSTRACT

A silent violin has a body structure, strings stretched over the body, a bridge held in contact with the strings and having two leg portions supported by the body structure and a piezoelectric converting unit inserted between the bridge and the body, although the piezoelectric converting unit is located under the two leg portions, the piezoelectric converting unit converts vibrations propagated from the strings through one of the two leg portions to an electric signal, and an electric system faithfully produces electric sounds to be expected from the electric signal without any interference between the vibrations propagated through the two leg portions.

6 Claims, 6 Drawing Sheets

SILENT STRINGED MUSICAL INSTRUMENT EQUIPPED WITH PICKUP FOR FAITHFULLY CONVERTING VIBRATIONS OF STRINGS TO ELECTRIC SIGNAL WITHOUT CHANGING VIBRATION CHARACTERISTICS OF BRIDGE

FIELD OF THE INVENTION

This invention relates to a stringed musical instrument and, more particularly, to a silent stringed musical instrument equipped with pickup for converting vibrations of strings to an electric signal.

DESCRIPTION OF THE RELATED ART

A typical example of the electric stringed musical instrument is an electric guitar. A neck projects from a solid body, and strings are stretched over the solid body. An electromagnetic pickup is provided under the strings, and the electromagnetic pickup converts the vibrations of the associated string to an electric signal. The electric signal is supplied to a filter/amplifier circuit, and a speaker produces an electric guitar sound from the electric signal.

On the other hand, an acoustic guitar has a sound chamber under the strings, and the sound chamber resonates with the vibrations of the strings. For this reason, the acoustic guitar sounds are radiated from the sound chamber, and give unique impression different from the electric guitar sounds to listener.

Similarly, a bowed stringed musical instrument such as violin produces an acoustic violin sound through resonance of the sound chamber with the vibrations of each string, and the acoustic violin sound is loud. However, the acoustic violin disturbs the neighbor. For this reason, a silent violin has been developed. The silent violin has a pickup under the strings. When a player bows the silent violin, the pickup produces an electric signal from the vibrations of the strings, and the electric signal is amplified and filtered. If a player hears the electric sounds from a headphone, he can practice the violin without disturbance to the neighbor.

Another silent violin is associated with an electronic sound generating system. A pickup also converts the vibrations of the strings to an analog signal, and a processor extracts pieces of music information from the analog signal. The pieces of music information are formatted into a music data code representative of pitches/velocity of a sound to be produced. The music data codes are supplied to a tone generator, and the tone generator produces an audio signal from the music data codes. The tone senerator imports an envelope of acoustic violin sound or other acoustic musical instrument to the audio signal, and a sound system produces electronic sounds from the audio signal.

Thus, either electric or electronic stringed musical instrument requires a pickup for producing an electric signal. As described hereinbefore, the acoustic stringed musical instruments such as an acoustic guitar and an acoustic violin produce acoustic guitar sounds and acoustic violin sounds from the resonant chambers defined in the bodies. A bridge is inserted between the body and the strings, and the vibrations are propagated from the strings through the bridge to the resonant chamber of the body. If the pickup directly detects the vibrations of the string, the electric/electronic sounds produced from the analog signal are different from the sounds to be expected, because the bridge serves as a kind of filter. For this reason, the silent violin already proposed is equipped with a pickup embedded in a bracket corresponding to the soundboard of an acoustic violin, and the bracket is located under the strings. The bridge of an acoustic violin usually has two leg portions, and the two leg portions are held in contact with the soundboard. The bridge of the silent violin has a similar configuration, and the two legs are held in contact with the bracket. The vibrations are propagated from a string through the two legs to the pickup. However, the electric/electronic sounds are sometimes weakened without damping the vibrations of the strings. Thus, the prior art silent stringed musical instrument has a problem in the stability

SUMMARY OF THE INVENTION

It is therefore an important object of the present invention to provide a silent stringed musical instrument, which faithfully produces electric/electronic sounds.

The present inventor contemplated the problem inherent in the prior art silent stringed musical instrument, and noticed that the vibrations of one leg sometimes became anti-phase to the other leg at a certain frequency. The vibrations of one leg canceled the vibrations of the other leg, and the unintentional change of loudness was due to the cancellation.

The present inventor held the pickup to one of the two legs. One of the legs was directly held in contact with the bracket, and the other leg was held in contact with the bracket through the pickup. In this instance, the pickup changed the frequency characteristics of the bridge, and a problem was encountered in the fidelity of the electric/electronic sound.

To accomplish the object, the present invention proposes to convert vibrations of strings to an electric signal through a pickup inserted between two legs of a bridge and a body structure but detecting the vibrations propagated through one of the two legs.

In accordance with one aspect of the present invention, there is provided a silent stringed musical instrument comprising a body structure including a body having an upper surface and a bridge having a supporting bridge portion and two leg portions projecting from the supporting bridge portion to the upper surface, at least one string stretched over the upper surface of the body and held in contact with the supporting bridge portion so as to propagate vibrations thereto, and a vibration-to-electric signal converter located between the two leg portions and the body and converting the vibrations propagated through one of the two leg portions to an electric signal.

BRIEF DESCRIPTION OF THE DRAWINGS

The features and advantages of the silent stringed musical instrument will be more clearly understood from the following description taken in conjunction with the accompanying drawings in which.

DESCRIPTION OF THF PREFERRED EMBODIMENT

Figure 1:
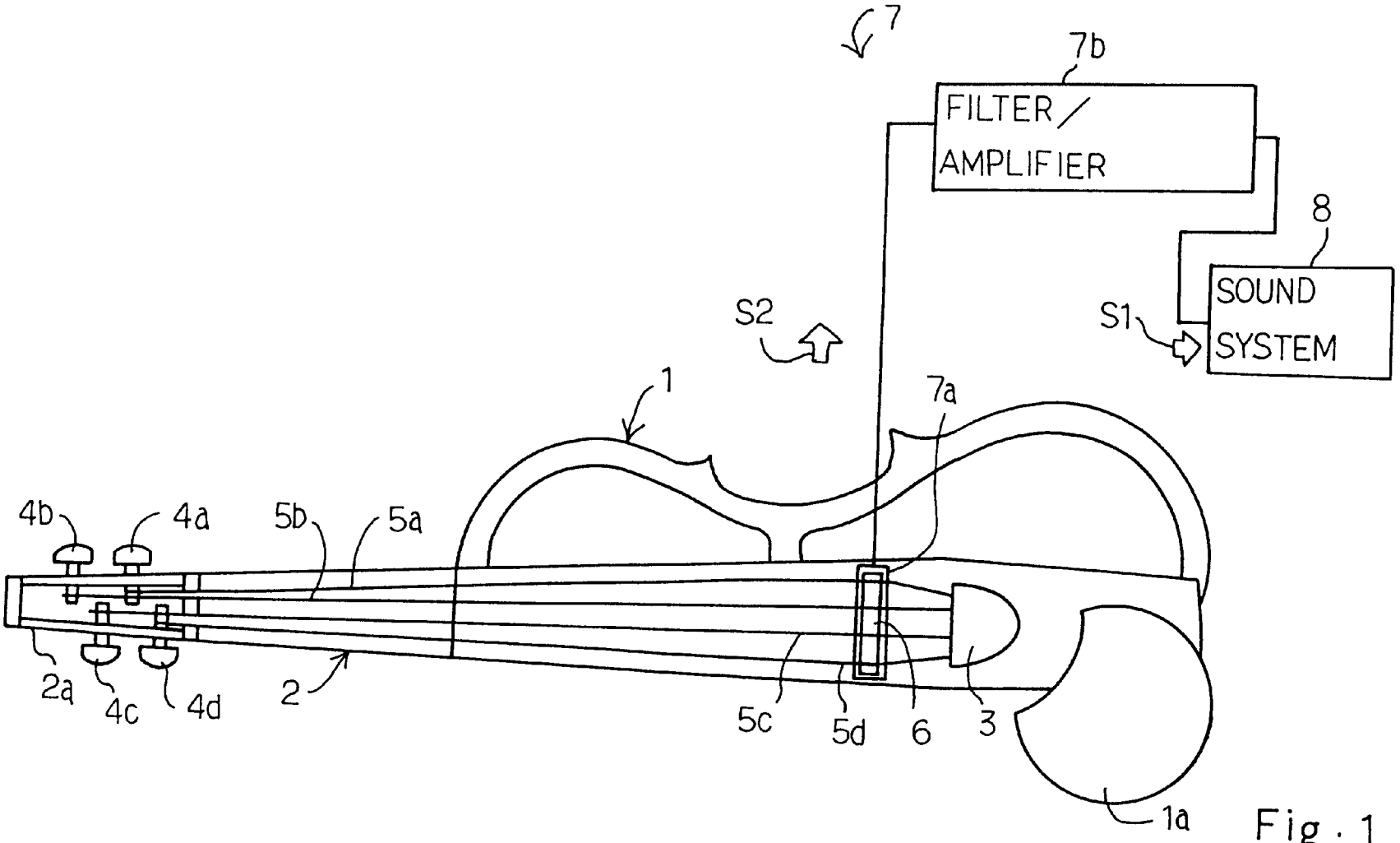
FIG. 1 is a plan view showing a silent violin according to the present invention.

Referring first to FIG. 1 of the drawings, a silent violin embodying the present invention comprises a body 1, a fingerboard 2 projecting from the body 1 and a string holder 3 attached to the body 1. The body 1 is solid, and no resonant chamber is formed in the body 1. The body 1 may be formed of wooden pieces or synthetic resin pieces. A suitable damping member may be inserted in the body 1 so as to damp the vibrations propagated to the body. The body 1 has a configuration like a half of the sound chamber of an acoustic violin, and the other half of the sound chamber is replaced with a chin rest 1*a*. While a violinist is playing a tune, he puts his chin on the chin rest 1*a*, and bows the silent violin. The fingerboard 2 has a peg box 2*a*, and the peg box 2*a* defines an inner space.

The silent violin further comprises four peg screws 4*a*, 4*b*, 4*c* and 4*d* and four strings 5*a*, 5*b*, 5*c* and 5*d*. The peg screws 4*a* to 4*d* are screwed into the peg box 2*a*, and project the leading end portions thereof into the inner space. The four strings 5*a* to 5*d* are respectively wound on the peg screws 4*a* to 4*d*, and are anchored at the other ends thereof to the string holder 3. Thus, the strings 5*a* to 5*d* are stretched between the peg screws 4*a* to 4*d* and the string holder 3.

The silent violin further comprises a bridge 6 attached to the body 1 under the strings 5*a* to 5*d*, an electric system 7 for producing an audio signal S1 from the vibrations of the string 5*a*/5*b*/5*c*/5*d* and a sound system 8 for producing electric sounds from the audio signal S1. The electric system 7 includes a pickup 7*a* described hereinlater in detail and a filter/amplifier circuit 7*b*. The bridge 6 is held in contact with the strings 5*a* to 5*d*, and propagates vibrations of the strings 5*a* to 5*d* to the pickup 7*a*. The pickup 7*a* converts the vibrations of the strings 5*a* to 5*d* to an analog signal S2, and the analog signal S2 is supplied from the pickup 7*a* to the filter/amplifier circuit 7*b*. The filter/amplifier circuit 7*b* filters and amplifies the audio signal S1, and supplies the audio signal S1 to the sound system 8. The sound system 8 produces the electric sounds. The sound system 8 may have a headphone.

Figure 2:
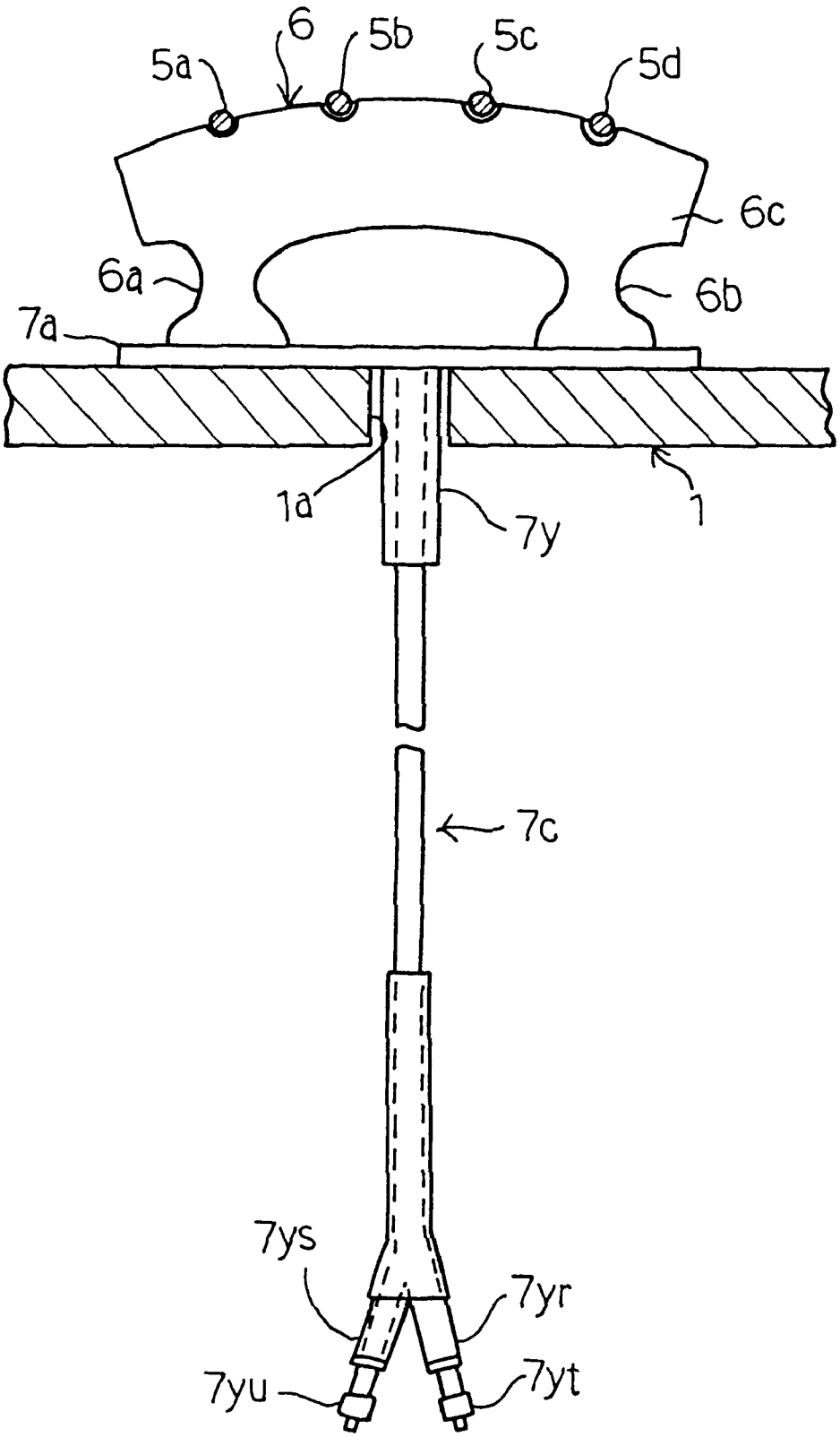
FIG. 2 is a cross sectional view showing a pickup incorporated in the silent violin according to the present invention.
Figure 3:
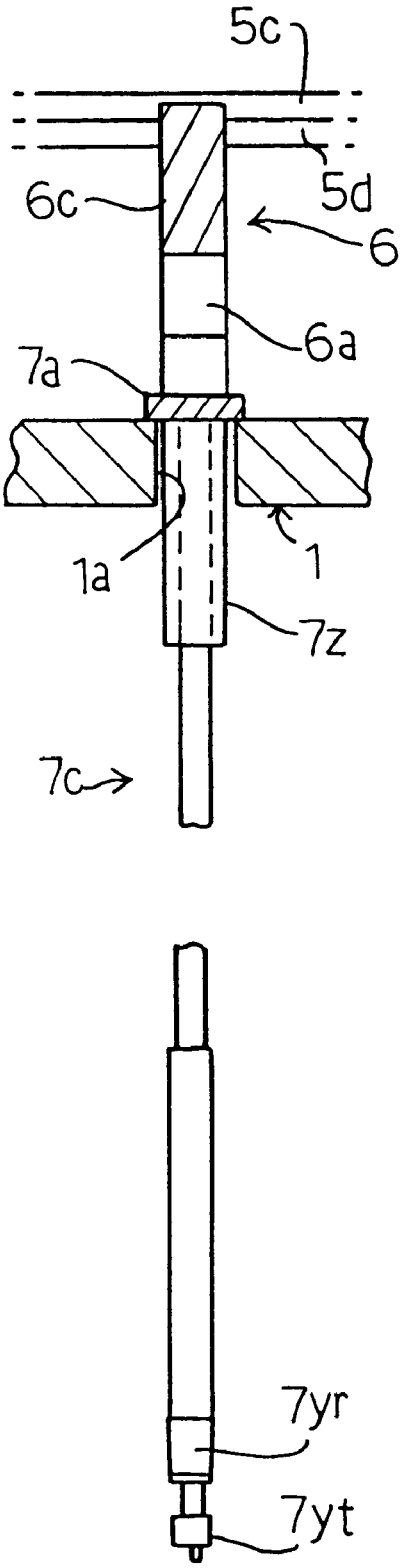
FIG. 3 is a cross sectional view from a different angle showing the pickup embedded in a bracket.

FIGS. 2 and 3 illustrates the bridge 6 incorporated in the silent violin. The bridge 6 is provided between the body 1 and the strings 5*a* to 5*d*, and a pickup 7*a* is inserted between the leg portions 6*a* and 6*b* of the bridge 6. The bridge 6 is implemented by a thin wooden plate, and has supporting bridge portion 6*c*and the leg portions 6*a*/6*b*. The strings 5*a* to 5*d* are received in grooves of the supporting bridge portion 6*c*, and the bridge 6 imparts tension to the strings 5*a* to 5*d*. The leg portions 6*a*/6*b* project from the both side portions of the supporting bridge portion 6*c*, and the leg portions 6*c*and the pickup 7*a* are fixed to the body 1. In this instance, a piezoelectric converting unit serves as the pickup 7*a*. While the strings 5*a* to 5*d* are vibrating, the vibrations are firstly propagated to the supporting bridge portion 6*c*, and pass the leg portions 6*a*/6*b*. The vibrations reach the pickup 7*a*, and the pickup 7*a* converts the vibrations to the electric signal S2.

Figure 4:
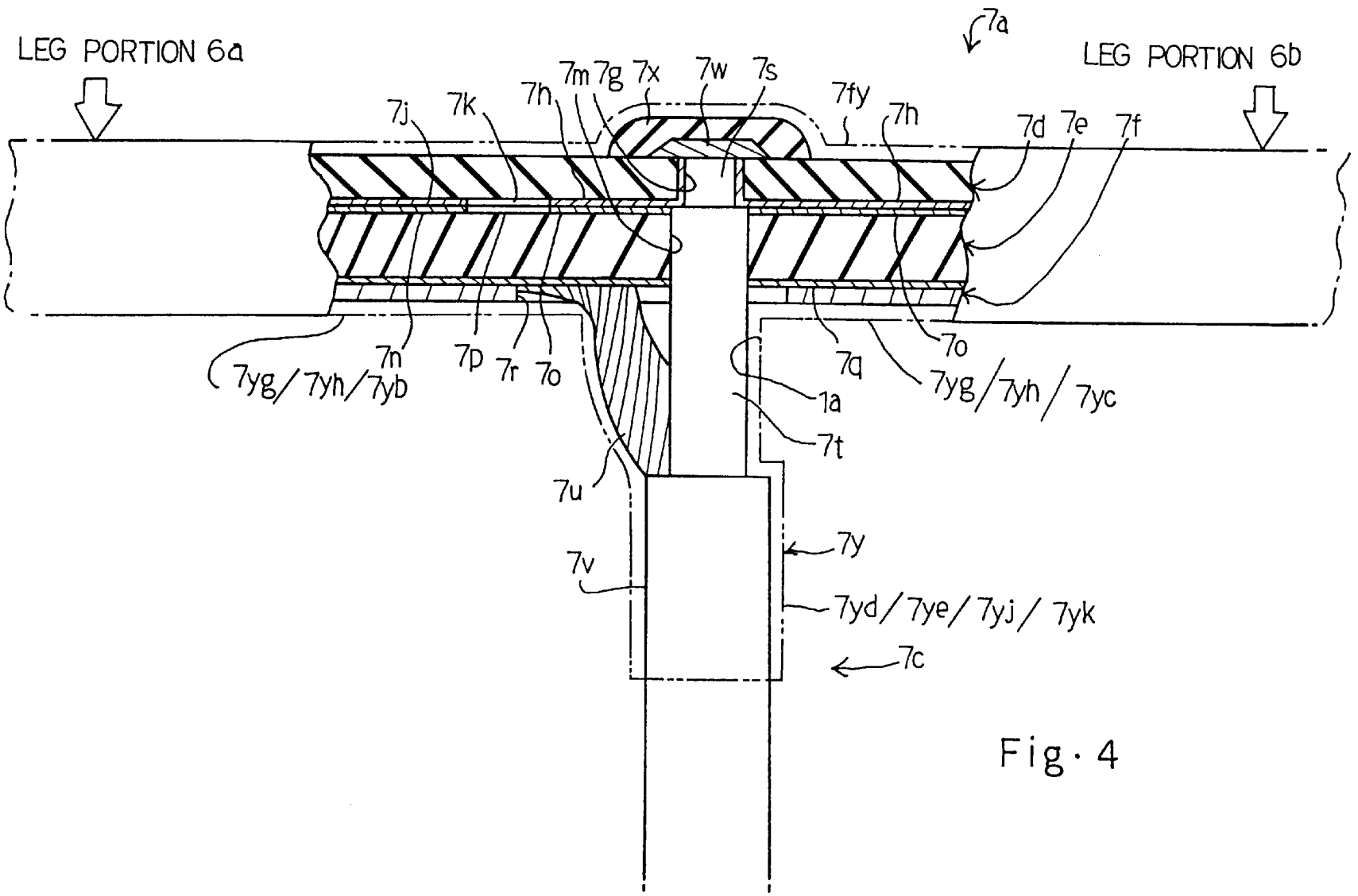
FIG. 4 is a partially cut-away front view showing the connection between a piezoelectric converting unit and a coaxial cable incorporated in the silent violin.
Figure 5:
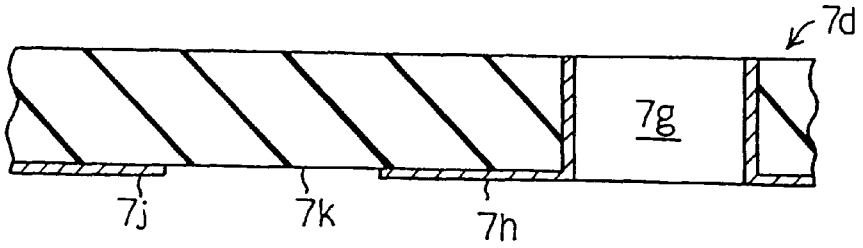
FIG. 5 is a cross sectional view showing a substrate incorporated in the piezoelectric converting unit.
Figure 6:
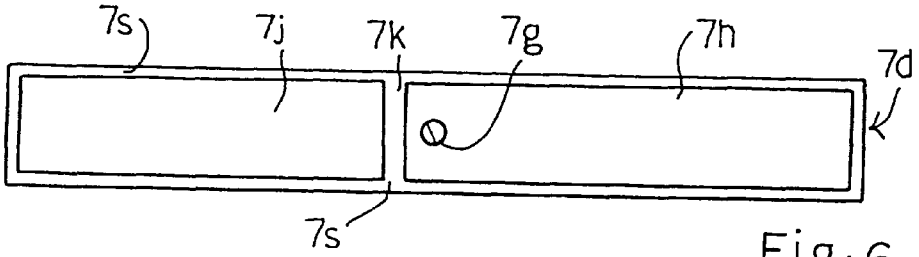
FIG. 6 is a bottom view showing the layout of the lower surface of the substrate.
Figure 7:
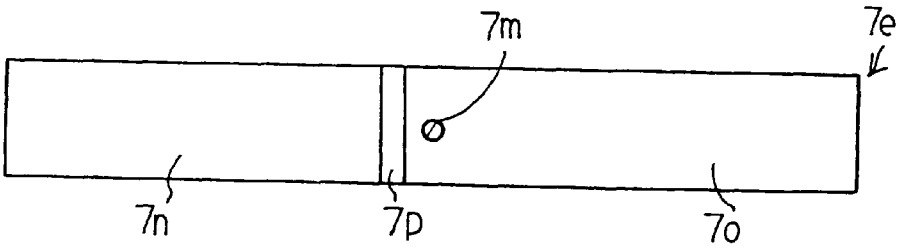
FIG. 7 is a plan view showing a piezoelectric element incorporated in the piezoelectric converting unit.
Figure 8:
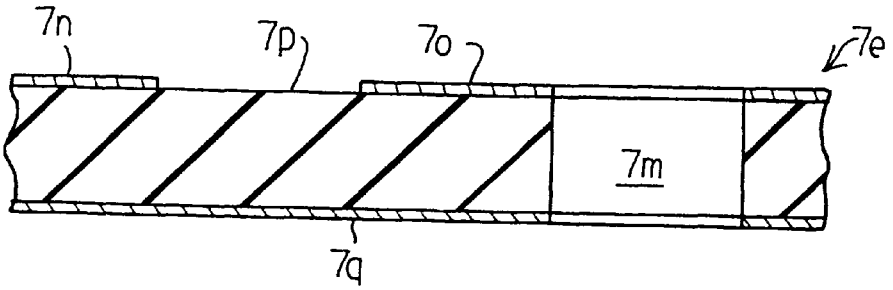
FIG. 8 is a cross sectional view showing the piezoelectric element.
Figure 9:
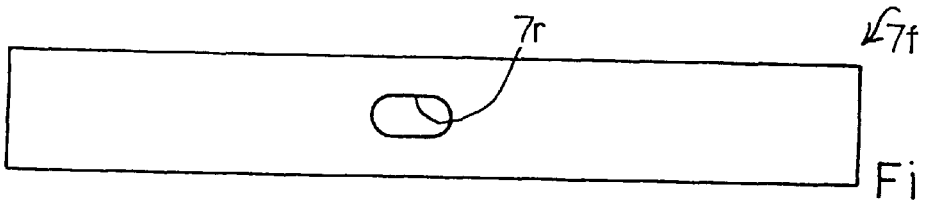
FIG. 9 is a plan view showing a ground electrode incorporated in the piezoelectric converting unit.
Figure 10:
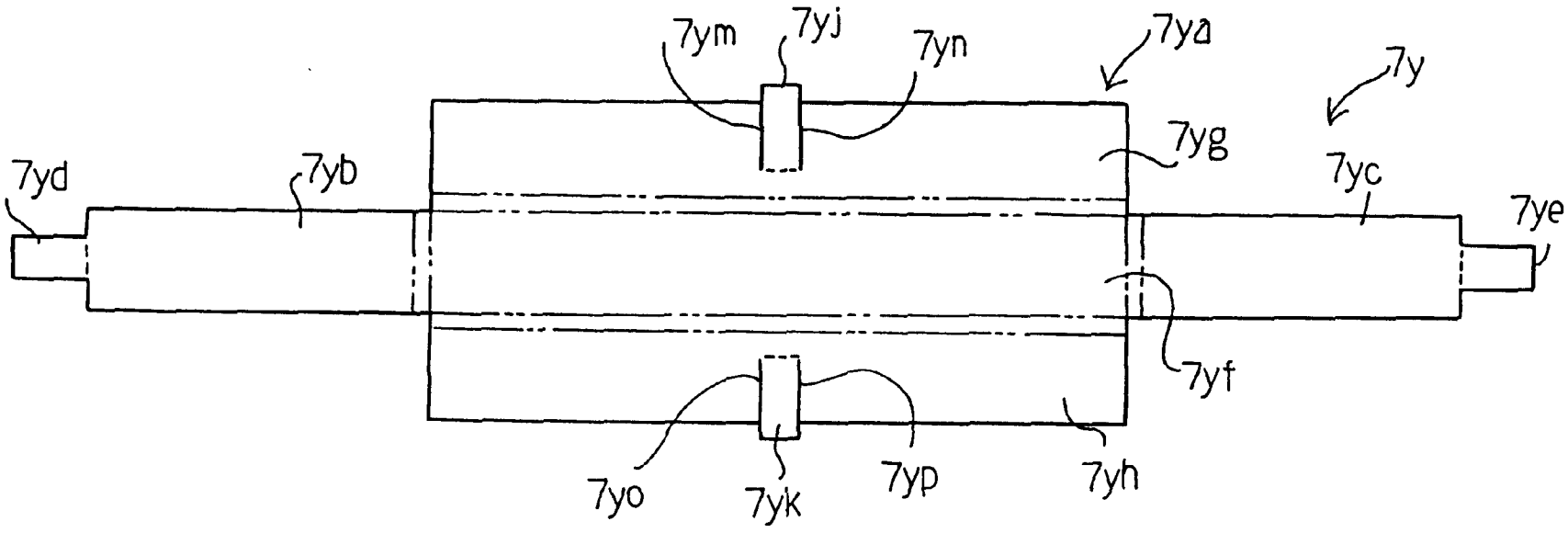
FIG. 10 is a development view showing a shield layer for the piezoelectric converting unit.

A through-hole 1*a*is formed in the body 1, and a lower surface of the pickup 7*a* is exposed to the through-hole 1*a*. A coaxial cable 7*c*is inserted into the through-hole 1*a*, and is connected to the piezoelectric converting, unit 7*a* as shown in FIG. 4. The piezoelectric converting unit 7*a* includes a substrate 7*d*, a piezoelectric element 7*e* bonded to the lower surface of the substrate 7*d* and a ground electrode 7*f* bonded to the lower surface of the piezoelectric element 7*e*. The substrate 7*d*, the piezoelectric element 7*e* and the ground electrode 7*f* are equal in length and width to one another, and are shaped into a rectangular configuration as shown in FIGS. 5 to 9.

The substrate 7*d* is formed of insulating material such as, for example, glass epoxy resin, and is uniform in thickness. A circular aperture 7*g* is formed in the substrate 7*d*, and is located on a virtual center line perpendicular to the longitudinal direction of the substrate 7*d*. The circular aperture 7*g* penetrates through the substrate 7*d* in a direction of thickness, and is exposed to the upper surface and the lower surface of the substrate 7*d*. Conductive strips 7*h* and 7*j* are formed on the lower surface of the substrate 7*d*, and are, by way of example, formed of copper or nickel silver. The conductive strips 7*h* and 7*j* are uniform in thickness, and the inner surface defining the circular aperture 7*g* is covered with the conductive strip 7*h*. Partition region 7*k* spaces the conductive strips 7*h*/7*j* from each other, and, accordingly, the conductive strips 7*h* and 7*j* are electrically isolated from each other. The partition region 7*k* extends in the direction of width of the substrate, and is slightly spaced from the aperture 7*g*. The conductive strips 7*h*/7*j* may be patterned from a conductive strip by using an etching technique.

The piezoelectric element 7*e* is, by way of example, formed of polyvinylidene fluoride, and is uniform in thickness. A circular aperture 7*m* is formed in the piezoelectric element 7*e*, and is also deviated from the virtual center line perpendicular to the longitudinal direction of the piezoelectric element 7*d*. Conductive strips 7*n*/7*o* of copper or nickel silver are formed on the upper surface of the piezoelectric element 7*d*, and are uniform in thickness. A partition region 7*p* separates the conductive strips 7*n*/7*o* from each other, and, accordingly, the conductive strips 7*n*/7*o* are electrically isolated from each other. The partition region 7*k* is also deviated from the virtual center line. The conductive strips 7*n*/7*o* are patterned from a conductive layer by using an etching. The lower surface of the piezoelectric element 7*e*is covered with a conductive layer 7*q* of copper or nickel silver, and the conductive layer 7*q* is uniform in thickness. The inner surface defining the circular aperture 7*m* is not covered with any conductive material.

The ground electrode 7*f* is formed of conductive material such as, for example, copper or nickel silver, and an elliptical aperture 7*r* is formed around the virtual center line perpendicular to the longitudinal direction of the ground electrode 7*f*.

The substrate 7*d*, the piezoelectric element 7*e*and the ground electrode 7*f* are laminated on one another, and adhesive compound on a peripheral area 7*s* and the partition regions 7*k*/7*p* bonds the substrate 7*d* to the piezoelectric element 7*e*. For this reason, the conductive strips 7*j*/7*h* are held in contact with the conductive strips 7*n*/7*o*, and no adhesive compound is interposed between the conductive strips 7*j*/7*h* of the substrate 7*d* and the conductive strips 7*n*/7*o* of the piezoelectric element 7*e*. The adhesive compound is insulative, and the conductive strips 7*j*/7*n* are electrically isolated from the conductive strips 7*h*/7*o*. The piezoelectric element 7*e* is bonded to the ground electrode 7*f* by using conductive adhesive compound, and the conductive layer 7*q* is held on contact with the ground electrode 7*f*. If the insulating adhesive compound is used for the assemblage between the piezoelectric element 7*e* and the ground electrode 7*f*, the insulating adhesive compound may bond a part of the piezoelectric element 7*e* and a part of the ground electrode 7*q* without breakage of electric path therebetween. The circular aperture 7*g* is aligned with the circular aperture 7*m*, and the elliptical aperture 7*r* is overlapped with the circular apertures 7*m*/7*g*. The through-hole 1*a* is further aligned with the elliptical aperture 7*r* and the circular apertures 7*m*/7*g*.

Turning back to FIG. 4, the coaxial cable 7*c* include conductive core line 7*s* coated with an inner PE insulating layer 7*t* and an outer conductive line 7*u* formed from a copper net and coated with an outer PVC insulating layer 7*v*. A leading end portion of the conductive core line 7*s* projects from the inner PE insulating layer 7*t*, and a leading end portion of the outer conductive line 7*u* is uncovered with the outer PVC insulating layer 7*v*. However, the inner PE insulating layer 7*t* electrically isolates the conductive core line 7*s* from the outer conductive line 7*u*.

The conductive core line 7*s* is inserted into the circular aperture 7*g*, and is bonded to the substrate 7*d* by means of a solder piece 7*w*. The solder piece 7*w* is coated with epoxy resin 7*x*, and the epoxy resin 7*x* electrically isolates the solder piece 7*w*. The conductive core line 7*s* is held in contact with the conductive strip 7*h* covering the inner surface defining the circular aperture 7*g*, and is electrically connected to the conductive layer 7*o* through the conductive strip 7*h*. However, the conductive strips 7*j*/7*n* are electrically isolated from the conductive core line 7*s*.

The inner PE insulating layer 7*t* is inserted into the circular aperture 7*m*, and the outer conductive line 7*u* is soldered to the ground electrode 7*f*. The outer conductive line 7*u* is held in contact with the conductive layer 7*q* in the elliptical aperture 7*r*. Thus, the outer conductive line 7*u* is electrically connected through the ground electrode 7*f* to the conductive layer 7*q*, and in never directly soldered to the conductive layer 7*q*. The reason why the outer conductive line 7*u* is indirectly connected to the conductive layer 7*q* is that the indirect connection prevents the piezoelectric material from destruction of the polarization during the soldering. The outer conductive line 7*u* is firstly soldered to the ground electrode 7*f*, and, thereafter, the ground electrode 7*f* is bonded to the piezoelectric element 7*e*. The laminated structure of the substrate 7*d*/ the piezoelectric element 7*e*/ the ground electrode 7*f*, the outer conductive line 7*u* and the inner PE insulating layer 7*t* are coated with a shield tape 7*y*.

The shield tape 7*y* is formed from an aluminum foil, and has a wide central portion 7*ya*, narrow end portions 7*yb*/7*yc* projecting from both sides of the wide central portion 7*ya* and tongue portions 7*yd*/7*ye* projecting from the narrow end portions 7*yb*/7*yc*, respectively. The shield tape 7*y* is bent along broken lines and dots-and-dash lines. A rectangular central area 7*yf* is brought into contact with the upper surface of the substrate 7*d*, and both rectangular side areas 7*yg*/7*yh* are bent toward the lower surface of the ground electrode 7*f*. The narrow end portions 7*yb*/7*yc* are also bent toward the lower surface of the ground electrode 7*f*, and either rectangular central area 7*yg*/7*yh* or the narrow end portion 7*yb*/7*yc* is directly held in contact with the lower surface of the ground electrode 7*f*. In this way, the rectangular side areas 7*yg*/7*yh* and the narrow end portions 7*yb*/7*yc* are laminated on the lower surface of the ground electrode 7*f*.

The shield tape 7*y* further includes tongue portions 7*yj*/7*yk* projecting from the rectangular side areas 7*yg*/7*yh*, and the rectangular side areas 7*yg*/7*yh* are partially cut along lines 7*ym*/7*yn* and 7*yo*/7*yp*. The inner PE insulating layer 7*t*, the outer conductive line 7*u* and the outer PVC insulating layer 7*v* are covered with the tongue portions 7*yd*/7*ye*/7*yj*/7*yk*. Thus, the laminated structure of substrate/piezoelectric element/ground electrode 7*d*/7*e*/7*f* and the coaxial cable 7*c*are shielded in the shield tape 7*y*, and the shield tape 7*c*prevents the piezoelectric converting unit 7*a* from external electromagnetic wave. The connecting portion of the coaxial cable 7*c*is further covered with a protective tube 7*za* of heat shrinkable resin, and the protective tube prevents 7*za* the shield tape 7*y* from friction on the body 1.

The coaxial cable 7*c*is branched at the other end into two end portions 7*yr*/7*ys*. The conductive core line 7*s* coated with an insulating layer form the end portion 7*yr*, and a connector 7*yt* is attached to the end portion 7*yr*. On the other hand, the conductive outer line 7*u* coated with an insulating layer form the other end portion 7*ys*, and another connector 7*yu* is attached to the other end portion 7*ys*. The connectors 7*yt*/7*yu* are connected to the filter/amplifier circuit 7*b*.

As will be understood from the foregoing description, the coaxial cable 7*c* electrically connects only the conductive strip 7*o* on the upper surface of the piezoelectric element 7*e* and the conductive layer 7*q* on the lower surface of the piezoelectric element 7*e* to the filter/amplifier circuit 7*b*, and the partition area 7*p* electrically isolates the conductive strip 7*n*on the upper surface of the piezoelectric element 7*e* from the conductive strip 7*o*. For this reason, the coaxial cable 7*c* provides the potential level on the upper surface of the right portion of the piezoelectric element 7*e* and the potential level on the lower surface of the piezoelectric element 7*e* to the filter/amplifier circuit 7*b*. The leg portions 6*a* and 6*b* are located over the conductive strips 7*n* and 7*o*, and the vibrations of strings 5*a* to 5*d* are propagated through the leg portions 6*a*/6*b* to the left portion of the piezoelectric element 7*e* and the right portion of the piezoelectric element 7*e*. Thus, although the vibrations are propagated to the entire upper surface of the piezoelectric element 7*e*, the filter/amplifier circuit 7*b* receives the electric signal S2 representative of the vibrations propagated through only the right portion of the piezoelectric element 7*e*. For this reason, the piezoelectric converting unit 7*a* equally affects the vibrations propagated through both leg portions 6*a*/6*b*; however, the piezoelectric converting unit 7*e* converts the vibrations propagated through the leg portion 6*b* to the electric signal S2 only. In this situation, even if one of the leg portions 6*a*/6*b* supplies the vibrations anti-phase to the vibrations propagated through the other leg portion, the electric signal S2 is never affected by the cancellation between the vibrations through the leg portions 6*a*/6*b*, and the electric system 7 faithfully produces the electric sounds to be expected. The vibrations pass through the piezoelectric converting unit 7*a*, and the piezoelectric converting unit 7*a* does not change the vibration characteristics of the bridge 6. Moreover, the coaxial cable 7*c*is integrated with the laminated structure of substrate 7*d*/ piezoelectric element 7*e*/ ground electrode 7*f*, and makes the assembling work and the repairing work easy.

Modifications

Although one particular embodiment of the present invention has been shown and described, it will be obvious to those skilled in the art that various changes and modifications may be made without departing from the spirit and scope of the present invention.

For example, the coaxial cable may be connected to an electronic sound generating system. In this instance, the electronic sound generating system extracts the pitch and the amplitude of the electric signal S2 after the amplification, and formats these pieces of music data information to a digital music data code. The digital music data codes are supplied to a tone generator, and the tone generator produces the audio signal S1 from the digital music data codes and another piece of music data information representative of a timbre of electronic sounds.

The electric signal S1, the digital music data codes or the audio signal may be supplied to another electronic system or recorded into a data storage medium.

The conductive layer 7*q* may be separated into two conductive strips as similar to the conductive strips 7*n*/7*o*. In this instance, the conductive strips 7*n*/7*o* may be not separated.

When the conductive layer 7*q* is separated into two conductive strips without integration of the conductive strips 7*n*/7*o*, not only the vibrations through the leg portion 6*a* but also the vibrations through the other leg portion may be independently converted to two electric signals. One of the electric signals is mainly used in the filter/amplifier circuit 7*b*, and the other electric signal may be used for enhancement of control or in a trouble such as disconnection of the cable for the one electric signal.

If the conductive strips 7*j*/7*n* are thin enough not to affect the vibration characteristics of the bridge 6 and the mechanical strength, only the conductive strips 7*h*/7*o* are formed on the substrate 7*d* and the piezoelectric element 7*e*, respectively. In this instance, the piezoelectric converting element 7*a* can detect the vibrations propagated through the leg portion 6*b* only. Even if one of the leg portions 6*a*/6*b* propagates the vibrations anti-plhase of the vibrations of the other leg portion 6*b*/6*a*, the cancellation does not take place.

The conductive strip 7*q* and the ground electrode 7*f* may be provided under one of the leg portions 6*a*/6*b*, only, so as to detect a potential difference between the conductive strip 7*n*/7*o* and the conductive strip 7*q*.

Two piezoelectric converting units may be separately provided under the leg portions 6*a*/6*b*. In this instance, the electric signal may be supplied from one of the piezoelectric converting units to the filter/amplifier circuit 7*b*. Each of the piezoelectric converting units may have the laminated structure, i.e., the upper conductive strip/the piezoelectric element/lower conductive strip. The above described changes may be applied to the piezoelectric converting units. For example, one of the upper and lower conductive strips may be deleted from one of the piezoelectric converting units. Two coaxial cables may be connected to the piezoelectric converting units, respectively, and the electric signals are used as described hereinbefore.

The pickup may be incorporated in another kind of bowed stringed musical instrument such as, for example, a viola or a plucked stringed musical instrument such as guitar in so far as a bifurcated bridge is provided between the strings and the body.

What is claimed is:

1. A silent stringed musical instrument comprising a body structure including a body having an upper surface and a bridge having a supporting bridge portion and two leg portions protecting from said supporting bridge portion to said upper surface, at least one string stretched over said upper surface of said body and held in contact with said supporting bridge portion so as to propagate vibrations thereto, and a vibration-to-electric signal converter located between said two lea portions and said body for converting said vibrations propagated through one of said two leg portions to an electric signal and including:

a piezoelectric element formed of piezoelectric material and having a first surface and a second surface reverse to said first surface, said first surface having a first area provided under one of said two leg portions and a second area provided under the other of said two leg portions, a first conductive layer attached to said first surface, a second conductive layer attached to said second surface, and a first conductive line and a second conductive line electrically connected to said first conductive layer and said second conductive layer, respectively, in such a manner as to propagate said electric signal.

2. The silent stringed musical instrument as set forth in claim 1, in which said first conductive layer is separated into a first conductive strip located under one of said two leg portions and a second conductive strip located under the other of said two leg portions.

3. The silent stringed musical instrument as set forth in claim 2, in which said vibration-to-electric signal converter further includes an insulating substrate having a lower surface, a third conductive strip sandwiched between said lower surface of said substrate and said first conductive strip and located under one of said two leg portions, a fourth conductive strip sandwiched between said lower surface of said substrate and said second conductive strip, located under said other of said two leg portions and electrically isolated from said third conductive strip, and a conductive electrode connected to said second conductive layer.

4. The silent stringed musical instrument as set forth in claim 3, in which said first conductive line is fixed to one of said first and second conductive strips, and said second conductive line is fixed to said conductive electrode.

5. The silent stringed musical instrument as set forth in claim 1, in which said piezoelectric material is polyvinylidene.

6. The silent stringed musical instrument as set forth in claim 4, in which said vibration-to-electric signal converter further includes a shield layer covering said first and second conductive strips, said piezoelectric element, said conductive layer and the connection between said first conductive line and said one of said first and second conductive strips and the connection between said second conductive line and said conductive electrode.

* * * * *